United States Patent [19]

White

[11] 4,027,939

[45] June 7, 1977

[54] ELECTRICAL CONNECTOR

[76] Inventor: Thomas William White, 612 E. 74th Terrace, Kansas City, Mo. 64131

[22] Filed: Mar. 3, 1976

[21] Appl. No.: 663,258

[52] U.S. Cl. ..... 339/247; 24/136 B; 403/374; 339/270 R

[51] Int. Cl.[2] ..... H01R 7/06

[58] Field of Search ..... 339/247, 249, 270, 273; 24/115 M, 136 B, 263 KS, 263 A, 263 LS; 403/368, 374

[56] References Cited

UNITED STATES PATENTS

| | | | |
|---|---|---|---|
| 1,801,277 | 4/1931 | Kelley | 339/247 |
| 1,909,332 | 5/1933 | Blackburn | 403/374 |
| 2,896,295 | 7/1959 | Fischer | 24/263 LS |
| 3,349,167 | 10/1967 | Mixon, Jr. et al. | 339/247 |

*Primary Examiner*—Joseph H. McGlynn

*Attorney, Agent, or Firm*—Schmidt, Johnson, Hovey & Williams

[57] ABSTRACT

A simplified, low-cost connector assembly for attaching tap lines to overhead electrical transmission or distribution conductors is provided which minimizes potential damage to the connected lines by provision of a cable-receiving housing and a complemental line-wedging block received therein along with means for gradually drawing the block into operative wedging position so as to preclude line damage which can occur with connector assemblies using driven-in-place wedge elements. The assembly hereof preferably includes a tapered, generally transversely C-shaped, line-receiving housing, in conjunction with a complementally tapered wedge block and bolt means for gradually drawing the block into tight, line-connecting engagement with the respective cable sections received within the C-shaped housing.

1 Claim, 5 Drawing Figures

Fig.1.
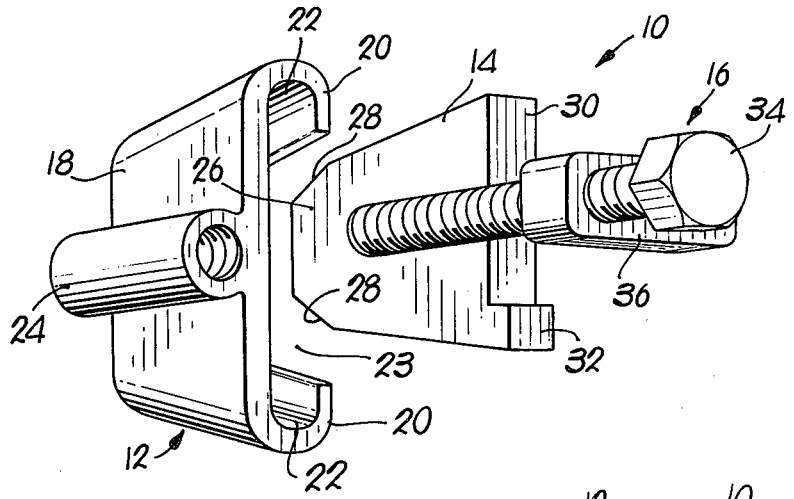
Fig.2.
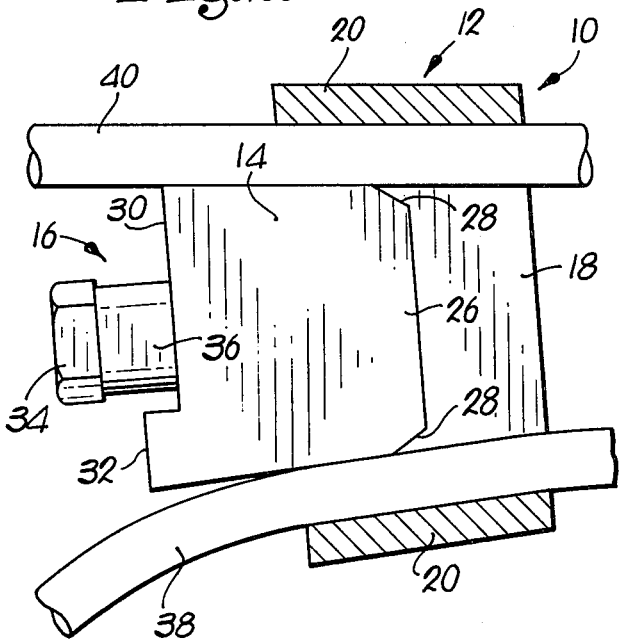
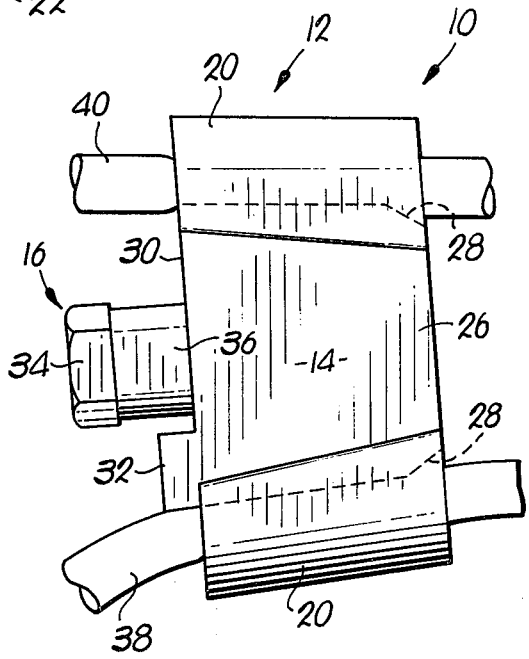
Fig.3.
Fig.4.
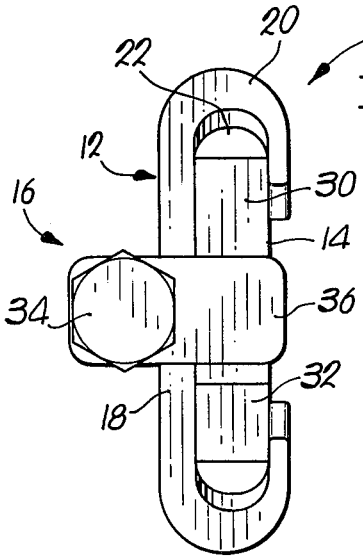
Fig.5.
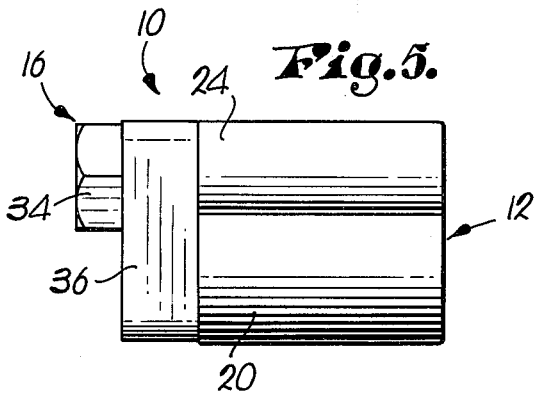

ELECTRICAL CONNECTOR

This invention relates to connector assemblies of the type used to mechanically and electrically connect tap lines or cables to overhead electrical transmission or distribution lines. More particularly, it is concerned with connector assemblies of the type including a housing and complemental wedge block, with means for gradually drawing the latter into operative engagement with the line segment to be connected so as to minimize the possibility of damage to the lines.

A number of connector assemblies have been proposed in the past for connecting tap lines to overhead electrical distribution conductors. For example, in U.S. Pat. No. 3,349,167, a connector is disclosed which employs an open-ended body and a complemental, longitudinally grooved wedge block for connecting the tap line to an overhead conductor. In this instance, the block is adapted to be driven into the main body in order tightly wedge the lines into place. As can be appreciated, damage to the lines can arise by virtue of hammering or otherwise driving the wedge block into a tightly fitting engagement with the surrounding housing and lines. Furthermore, any initial damage done to the lines by virtue of this type of installation can be compounded during high wind or other ambient conditions encountered in practice where the conductors tend to vibrate or gallop. This galloping can cause connectors and other line hardware to rotate on the main distribution line and thus damage the same.

Other similar types of connector assemblies include those disclosed in U.S. Pat. Nos. 3,516,050 and 3,462,543. However, these connector assemblies are likewise deficient in that the installation of the wedge block thereof can have the effect of damaging the lines to be connected.

It is therefore the most important object of the present invention to provide a simplified, low-cost connector assembly for mechanically and electrically connecting cable segments such as a main electrical transmission distribution line and a tap conductor and which can be installed without causing damage to the connected lines either during such installation or long-term service.

Another object of the invention is to provide a connector assembly of the type described which includes a longitudinally tapered, generally transversely C-shaped housing adapted to be suspended from an overhead distribution line and receive the end of a tap conductor, in conjunction with a complementally tapered wedge block received within the housing and bolt means for threadably drawing the wedge block into the housing in a gradual manner for insuring that no damage is done to the cable elements being connected.

In the drawing:

FIG. 1 is an exploded, perspective view of a connector assembly in accordance with the invention;

FIG. 2 is a view in partial vertical section of the connector assembly of the invention, shown during initial installation procedures with a pair of cable elements;

FIG. 3 is a side elevational view showing the final configuration of the connector assembly after connection of the cable elements;

FIG. 4 is an end elevational view of the connector assembly of the invention with the parts thereof interfitted together; and FIG. 5 is a top plan view of the assembly depicted in FIG. 4.

Connector assembly 10 in accordance with the invention broadly includes an elongated, longitudinally tapered, generally transversely C-shaped, open-ended housing 12, a complementally tapered wedge block 14 configured for reception in housing 12, and bolt means 16 for drawing the block 14 into a complemental, nested, wedging engagement within housing 12.

In more detail, housing 12, as best seen in FIG. 1, includes a generally planar back portion 18 and a pair of spaced, opposed, generally arcuate upper and lower portions 20 which define respective line-receiving openings 22. The portions 18, 20 cooperatively present an open front block-receiving area or space 23. An elongated, internally threaded sleeve member 24 is mounted on the outer surface of back portion 18 remote from space 23 for purposes which will be made clear hereinafter.

Wedge block 14 is complementally configured for nesting insertion within housing 12 and includes a leading portion 26 having a pair of beveled surfaces 28 which facilitate initial positioning and insertion of block 14 into housing 12 as best seen in FIG. 2. In addition, block 14 includes a generally planar rearmost surface 30 and a rearwardly extending, marginal lug 32 adjacent one end of surface 30.

Bolt means 16 includes an elongated, threaded bolt 34 which is adapted for threaded advancement into sleeve member 24. An elongated, apertured drawing element 36 also forms a part of bolt means 34, and is slipped onto bolt 34 as shown and is rotatable with respect thereto.

During installation procedures in electrically connecting a tap line 38 to an overhead distribution conductor 40 (see FIGS. 2 and 3), the following procedure is followed. First, housing 12 is suspended from conductor 40 by pushing the latter into the upper opening 22 of the housing. At this point, the upper end of tap line 38 is positioned within the opposed, lower opening 22, and wedge block 14 is initially positioned within housing 12 between the lines to be connected as shown in FIG. 2. Bolt 34 and drawing element 36 are then positioned so that bolt 34 is partially threaded into sleeve member 24 with element 36 being in engagement with rear surface 30 of block 14. Bolt 34 is then threaded into sleeve member 24 which in turn causes element 36 to gradually draw block 14 into housing 12 and thus into wedging engagement with the conductor 40 and tap line 38, as best seen in FIG. 3.

One important feature of the present invention resides in the provision of rearwardly extending lug 32. This lug serves to prevent rotation of element 36 during the advancement of bolt 34 so that a continuing engagement is maintained between element and the wedge block. Absent lug 32, element 36 could rotate during advancement of bolt 34 and thus slip out of engagement with block 14. As can be appreciated from the foregoing, the gradual wedging action of block 14 into housing 12 insures that connector 40 and tap line 38 are not damaged during installation procedures. However, a secure mechanical and electrical connection is nevertheless achieved with assembly 10 which can withstand ambient wind load conditions and the like encountered in use.

Having thus described the invention, what is claimed as new and desired to be secured by Letters Patent is:

1. A connector assembly for electrically joining a pair of cable members, comprising:

a housing having structure defining respective cable receiving areas therein for receiving said pair of cable members;

a wedge block positioned within said housing and complementally configured therewith for tightly wedging said cable members into the body members, said wedge block having a tapered leading portion, a generally planar rearmost surface and a lug extending rearwardly from said rearmost surface; and means for drawing the wedge block into wedging engagement with said cable members and including a bolt receiving sleeve mounted on the housing, bolt means threadably received within the sleeve and an element rotatably carried by said bolt and extending laterally therefrom for engaging said rearmost surface of the wedge block, said lug preventing rotation of said element during tightening of the bolt.

* * * * *